US009959992B1

(12) United States Patent
Chen

(10) Patent No.: US 9,959,992 B1
(45) Date of Patent: May 1, 2018

(54) KEYBOARD DEVICE

(71) Applicant: Primax Electronics Ltd., Taipei (TW)

(72) Inventor: Bo-An Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days. days.

(21) Appl. No.: 15/596,176

(22) Filed: May 16, 2017

(30) Foreign Application Priority Data

Jan. 6, 2017 (TW) ..... 106100447 A

(51) Int. Cl.
*H01H 3/12* (2006.01)
*H01H 13/705* (2006.01)
*H01H 13/83* (2006.01)

(52) U.S. Cl.
CPC ..... *H01H 13/705* (2013.01); *H01H 3/125* (2013.01); *H01H 13/83* (2013.01); *H01H 2221/026* (2013.01); *H01H 2221/062* (2013.01)

(58) Field of Classification Search
CPC ..... H01H 3/125; H01H 13/83; H01H 13/705; H01H 13/14; H01H 13/70; H01H 2221/062; H01H 2221/026; H01H 9/26; H01H 13/72; H01H 25/00; H01H 25/04; H01H 1/02
USPC ..... 200/5 A, 344, 341–345, 512, 314, 301; 400/490, 491, 491.2, 495.1, 496
See application file for complete search history.

(56) References Cited

U.S. PATENT DOCUMENTS 5,463,195 A * 10/1995 Watanabe ..... H01H 3/125 200/344
5,504,283 A * 4/1996 Kako ..... H01H 3/125 200/344
5,901,837 A * 5/1999 Aimi ..... H01H 3/125 200/344
6,586,695 B2 * 7/2003 Sato ..... H01H 3/122 200/344
6,613,996 B2 * 9/2003 Lee ..... H01H 3/125 200/344
6,781,077 B2 * 8/2004 Olodort ..... H01H 3/125 200/344
7,994,446 B2 * 8/2011 Chao ..... H01H 3/125 200/344
2011/0297525 A1 * 12/2011 Tsai ..... H01H 13/705 200/517

* cited by examiner

*Primary Examiner* — Ahmed Saeed
(74) *Attorney, Agent, or Firm* — Kirton McConkie; Evan R. Witt

(57) ABSTRACT

A keyboard device includes a key structure, a base plate and a soft fixing element. The key structure includes a keycap and a stabilizer bar. The stabilizer bar is connected with the keycap and the soft fixing element. The soft fixing element is disposed on the base plate. The soft fixing element has an accommodation space. The stabilizer bar is inserted into the accommodation space, so that the stabilizer bar is connected with the base plate. After a fixing post of the soft fixing element is penetrated through a fixing hole of the base plate, the fixing post is thermally treated to form the hot melt fixing structure. Consequently, the soft fixing element is firmly fixed on the base plate. Since the metallic stabilizer bar and the metallic base plate are separated by the soft fixing element, the keyboard device is capable of reducing noise.

9 Claims, 9 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices. The subject of the present invention is related to a keyboard device.

FIG. 1 is a schematic top view illustrating the outer appearance of a conventional keyboard device. As shown in FIG. 1, plural key structures 10 and 10' are disposed on a top surface of the conventional keyboard device 1. The key structures 10 have the ordinary sizes. The key structures 10' are relatively longer. That is, the length of the key structure 10 is slightly larger than the width of the key structure 10, and the length L1 of the key structure 10' is much larger than the width W1 of the key structure 10'. When one of the key structures 10 and 10' is depressed by the user's finger, a corresponding key signal is generated to the computer, and thus the computer executes a function corresponding to the depressed key structure. Generally, the user may depress the key structures 10 and 10' to input corresponding English letters (or symbols) or numbers or execute various functions (e.g., F1~F12 or Delete). For example, the conventional keyboard device 1 is a keyboard for a notebook computer.

The structures of the conventional keyboard device will be illustrated as follows. FIG. 2 is a schematic exploded view illustrating a portion of the conventional keyboard device and taken along a viewpoint. FIG. 3 is a schematic exploded view illustrating a portion of the conventional keyboard device and taken along another viewpoint. Please refer to FIGS. 1, 2 and 3. The conventional keyboard device 1 comprises plural key structures 10 and 10', a metallic base plate 11 and a membrane circuit board 12. The membrane circuit board 12 comprises plural membrane switches 121 corresponding to the plural key structures 10 and 10'. Each of the plural key structures 10 and 10' comprises a keycap 101, at least one scissors-type connecting element 102 and a rubbery elastomer 103. The scissors-type connecting element 102 is connected between the keycap 101 and the metallic base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The rubbery elastomer 103 is arranged between the keycap 101 and the metallic base plate 11. Moreover, the rubbery elastomer 103 comprises a contacting part 1031.

While the keycap 101 of any key structure 10 or 10' is depressed and moved downwardly relative to the metallic base plate 11, the first frame 1021 and the second frame 1022 of the scissors-type connecting element 102 are switched from an open-scissors state to a stacked state. Moreover, as the keycap 101 is moved downwardly to compress the rubbery elastomer 103, the corresponding membrane switch 121 is pushed and triggered by the contacting part 1031 of the rubbery elastomer 103. Consequently, the membrane circuit board 12 generates a corresponding key signal. When the keycap 101 of the key structure 10 or 10' is no longer depressed, the keycap 101 is moved upwardly relative to the metallic base plate 11 in response to an elastic force of the rubbery elastomer 103. Meanwhile, the first frame 1021 and the second frame 1022 are switched from the stacked state to the open-scissors state again, and the keycap 101 is returned to its original position.

In the keyboard device 1, the key structures 10' and the key structures 10 are distinguished. As shown in the drawings, the length L1 of the key structure 10' is much larger than the width W1 of the key structure 10'. Since the length L1 of the keycap 101 of the key structure 10' is relatively longer, the keycap 101 is readily rocked while the key structure 10' is depressed. That is, the operating smoothness of the key structure 10' is adversely affected, and even the tactile feel of the user is impaired. For increasing the operating smoothness of the key structure 10', the key structure 10' is further equipped with a special mechanism. For example, the key structure 10' further comprises a first stabilizer bar 104 and a second stabilizer bar 105. The first stabilizer bar 104 comprises a first linking bar part 1041 and two first hook parts 1042. The two first hook parts 1042 are located at two ends of the first stabilizer bar 104, respectively. The second stabilizer bar 105 comprises a second linking bar part 1051 and two second hook parts 1052. The two second hook parts 1052 are located at two ends of the second stabilizer bar 105, respectively.

The metallic base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first linking bar part 1041 of the first stabilizer bar 104 and the second linking bar part 1051 of the second stabilizer bar 105 are pivotally coupled to the keycap 101 of the key structure 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively.

FIG. 4 is a schematic perspective view illustrating a portion of the combination of the metallic base plate and the membrane circuit board of the conventional keyboard device. FIG. 5 schematically illustrates the actions of the first stabilizer bar and the second stabilizer bar of the conventional keyboard device. Please refer to FIGS. 4 and 5. While the keycap 101 of the key structure 10' is moved upwardly or downwardly relative to the metallic base plate 11, the first stabilizer bar 104 is moved in a first direction D11 or a second direction D12 and rotated in a first rotating direction D13 or a second rotating direction D14. Similarly, the second stabilizer bar 105 is moved in the first direction D11 or the second direction D12 and rotated in the first rotating direction D13 or the second rotating direction D14. By the first stabilizer bar 104 and the second stabilizer bar 105, the key structure 10' is kept stable and not inclined while the key structure 10' is moved upwardly or downwardly relative to the metallic base plate 11. Moreover, the uses of the first stabilizer bar 104 and the second stabilizer bar 105 are helpful to increase the strength of the keycap 101.

However, the conventional keyboard device 1 still has some drawbacks. For example, all of the first stabilizer bar 104, the second stabilizer bar 105 and the metallic base plate 11 are made of metallic material. Please refer to FIGS. 4 and 5. While the keycap 101 of the key structure 10' is moved upwardly or downwardly relative to the metallic base plate 11 and the first stabilizer bar 104 and the second stabilizer bar 105 are correspondingly moved and rotated, the two first hook parts 1042 of the first stabilizer bar 104 and the two second hook parts 1052 of the second stabilizer bar 105 are readily contacted with the metallic base plate 11. While the two first hook parts 1042 and the two second hook parts 1052 collide with the metallic base plate 11, a click sound is generated. Especially when the R corners of the two first hook parts 1042 and the two second hook parts 1052 (e.g., the regions indicated by oblique lines of FIG. 5) collide with the metallic base plate 11, the click sound is generated. This sound is unpleasant noise to the user.

Therefore, there is a need of providing a keyboard device with reduced noise.

SUMMARY OF THE INVENTION

An object of the present invention provides a keyboard device with reduced noise.

In accordance with an aspect of the present invention, there is provided a keyboard device. The keyboard device includes a key structure, a switch circuit board, a base plate and a soft fixing element. The key structure includes a keycap and a stabilizer bar. The keycap is exposed outside the keyboard device. The stabilizer bar is connected with the keycap, and includes a linking bar part and a hook part. The linking bar part is connected with the keycap. The hook part is located at an end of the linking bar part. The switch circuit board is located under the key structure. When the switch circuit board is triggered, a key signal is generated. The base plate is located under the switch circuit board, and supports the key structure. The soft fixing element is disposed on the base plate and connected with the hook part, and includes a main body and an accommodation space. The accommodation space is disposed within the main body. The hook part is inserted into the accommodation space, so that the hook part is permitted to be moved within the accommodation space.

From the above descriptions, the present invention provides the keyboard device. The soft fixing elements are disposed on the base plate. The first hook parts and the second hook parts are separated from the base plate through the soft fixing elements. There are two approaches of combining the soft fixing elements and the base plate together. In accordance with a first approach, the fixing posts are penetrated through the corresponding fixing holes to initially fix the soft fixing elements on the base plate and then the fixing posts are thermally treated to form the hot melt fixing structures. In accordance with a second approach, the first engaging structure and the second engaging structure having complementary shapes are engaged with each other in a movable manner, so that the soft fixing elements are fixed on the base plate. The first connecting structures and the second connecting structures that are made of the metallic material and used in the conventional keyboard device are replaced by the soft fixing elements according to the present invention. The soft fixing elements are made of the soft material. Even if the first hook parts and the second hook parts are made of the metallic material, the first hook parts and the second hook parts are only contacted with the soft fixing elements but not contacted with the metallic material. That is, the metallic components do not collide with the base plate to generate the unpleasant noise. Consequently, the keyboard device of the present invention is capable of reducing the noise.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technologies, the present invention provides a keyboard device. First of all, the structure of the keyboard device will be illustrated as follows.

Figure 1:
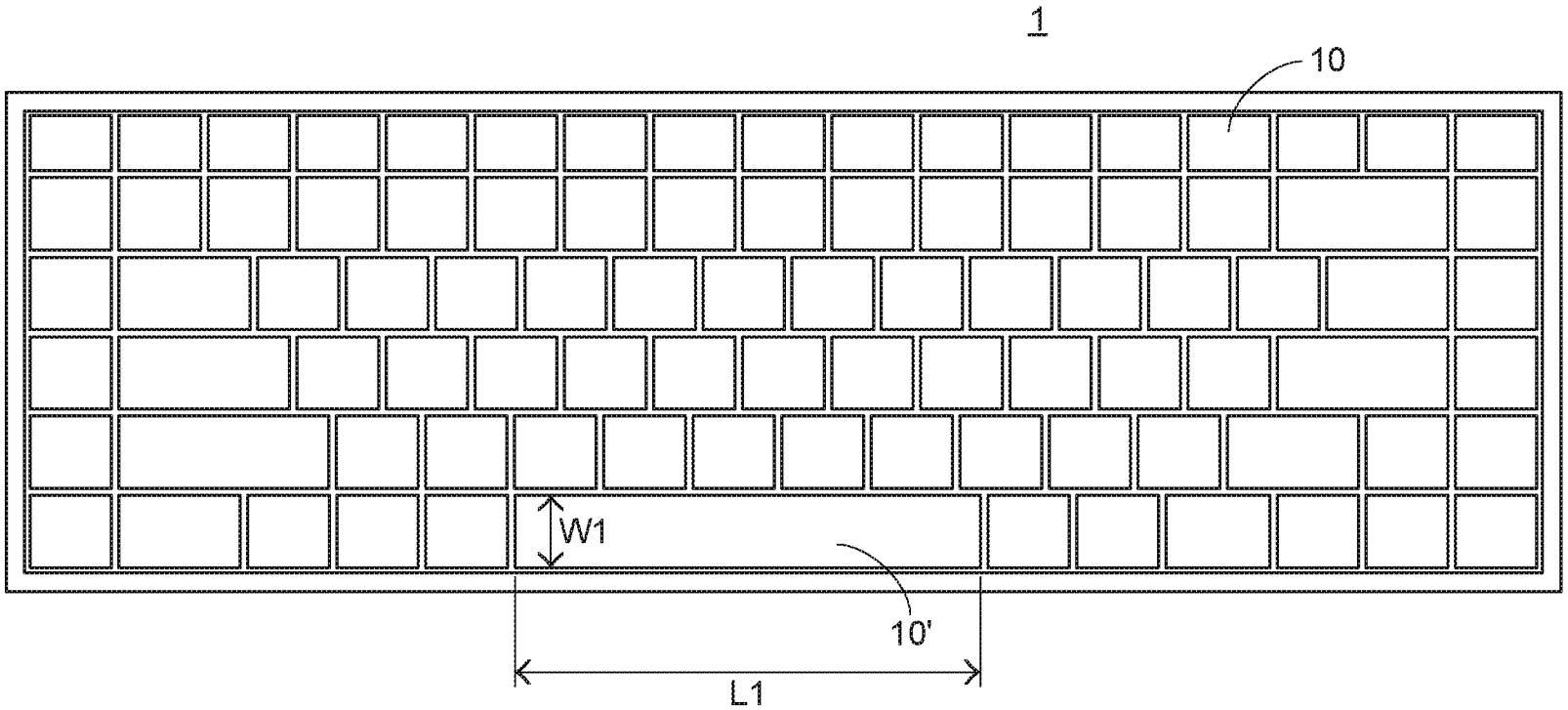
FIG. 1 PRIOR ART
FIG. 1 is a schematic top view illustrating the outer appearance of a conventional keyboard device.
Figure 2:
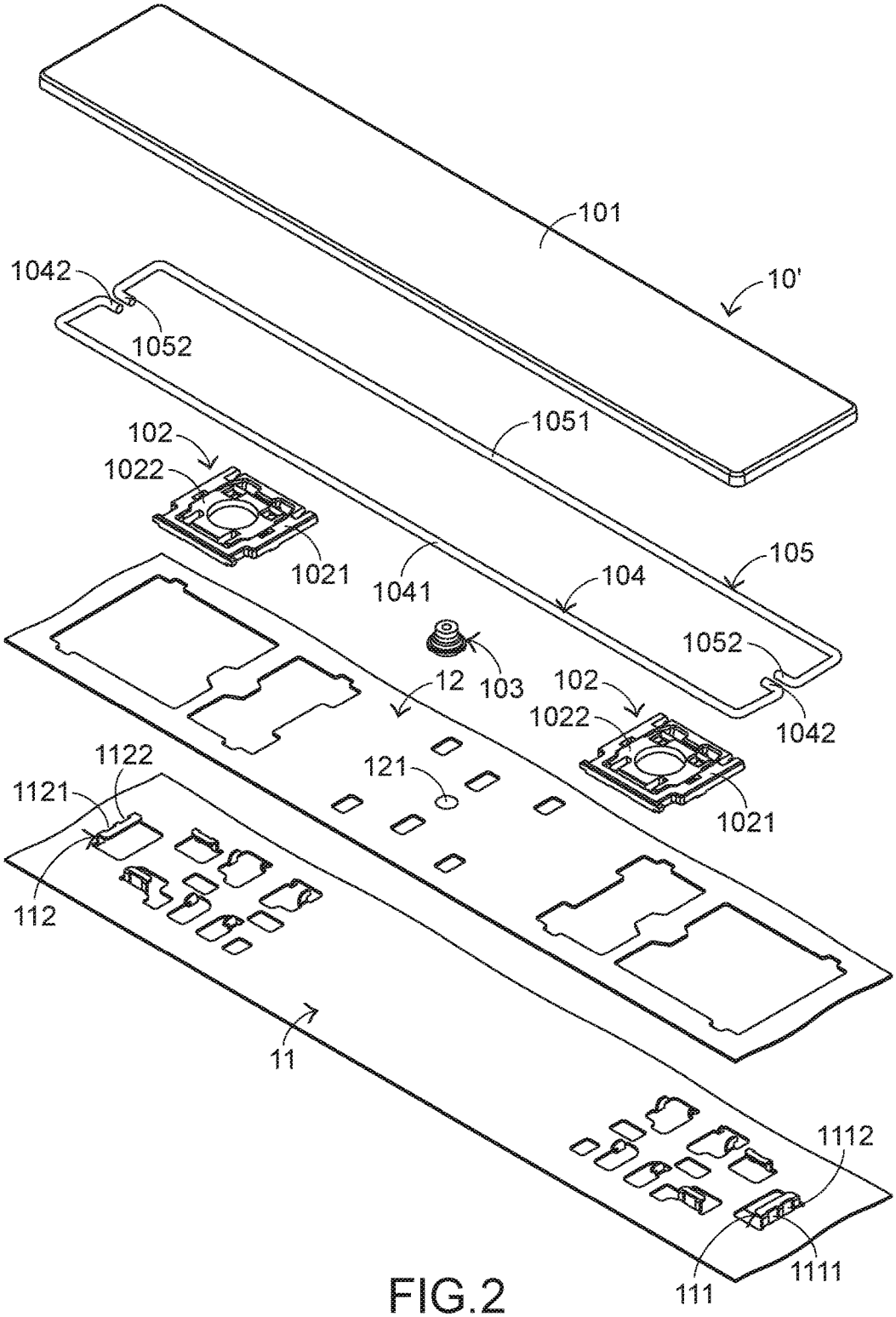
FIG.2 PRIOR ART
FIG. 2 is a schematic exploded view illustrating a portion of the conventional keyboard device and taken along a viewpoint.
Figure 3:
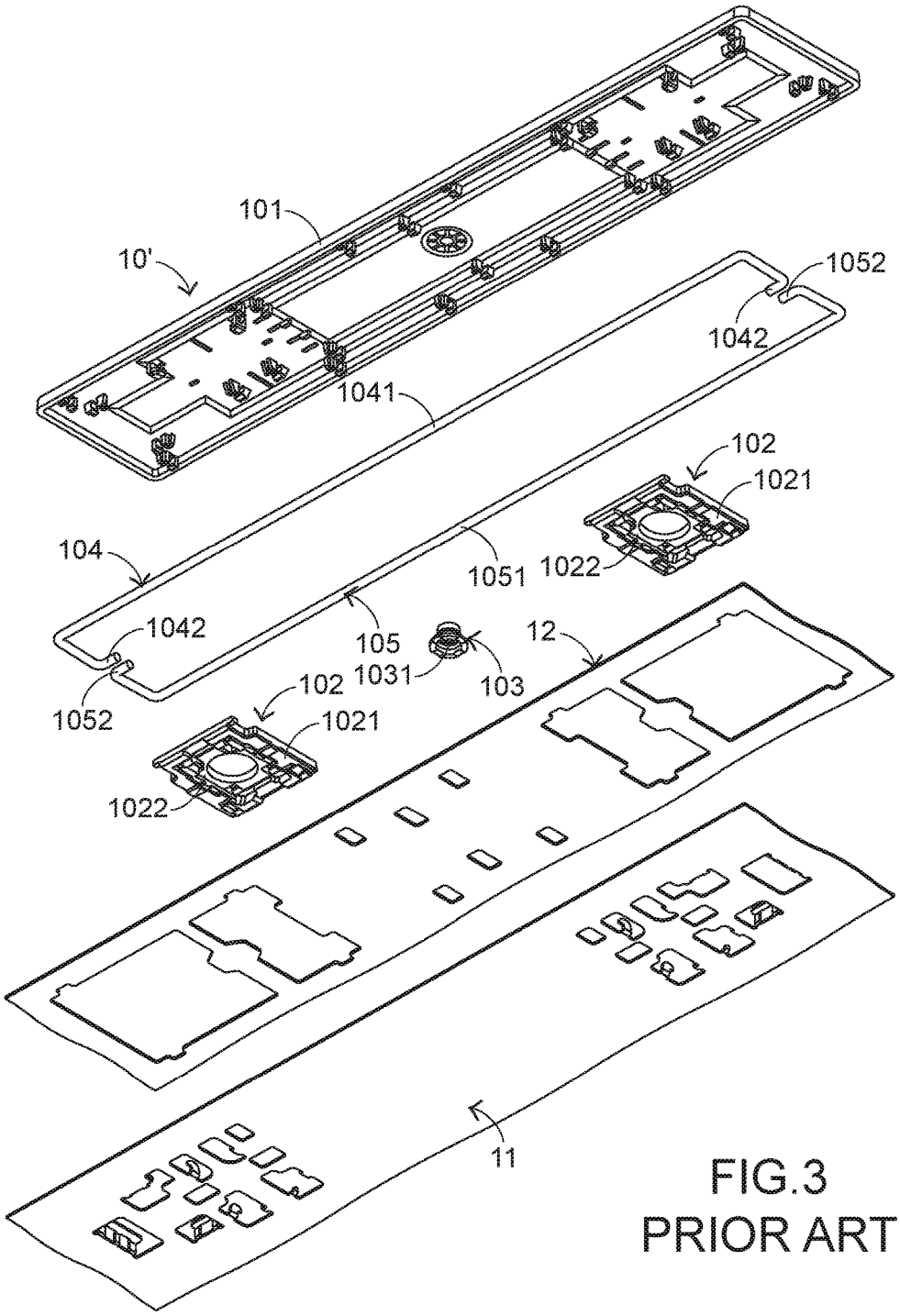
FIG.3 PRIOR ART
FIG. 3 is a schematic exploded view illustrating a portion of the conventional keyboard device and taken along another viewpoint.
Figure 4:
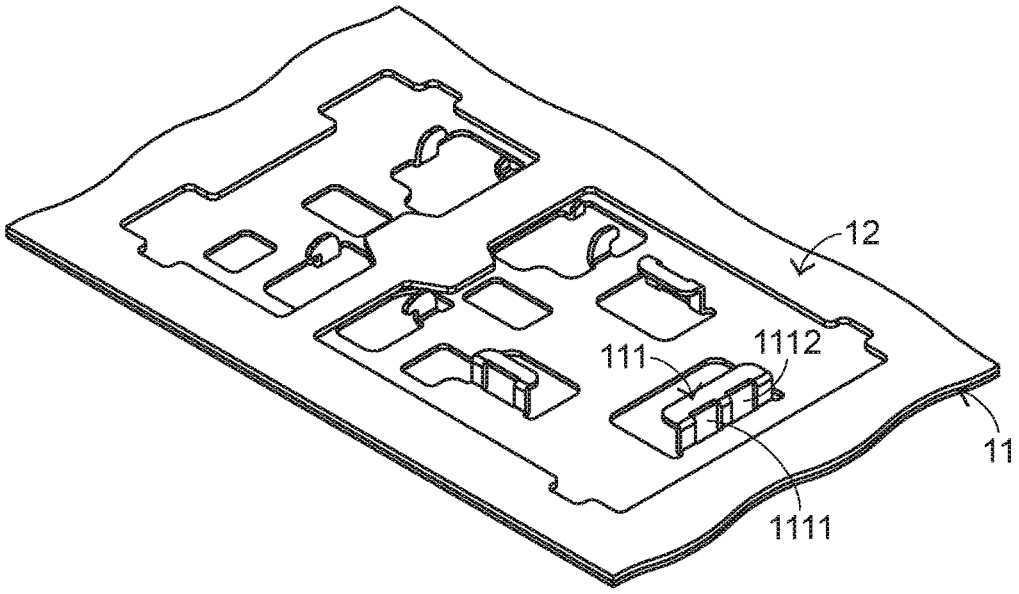
FIG.4 PRIOR ART
FIG. 4 is a schematic perspective view illustrating a portion of the combination of the metallic base plate and the membrane circuit board of the conventional keyboard device.
Figure 5:
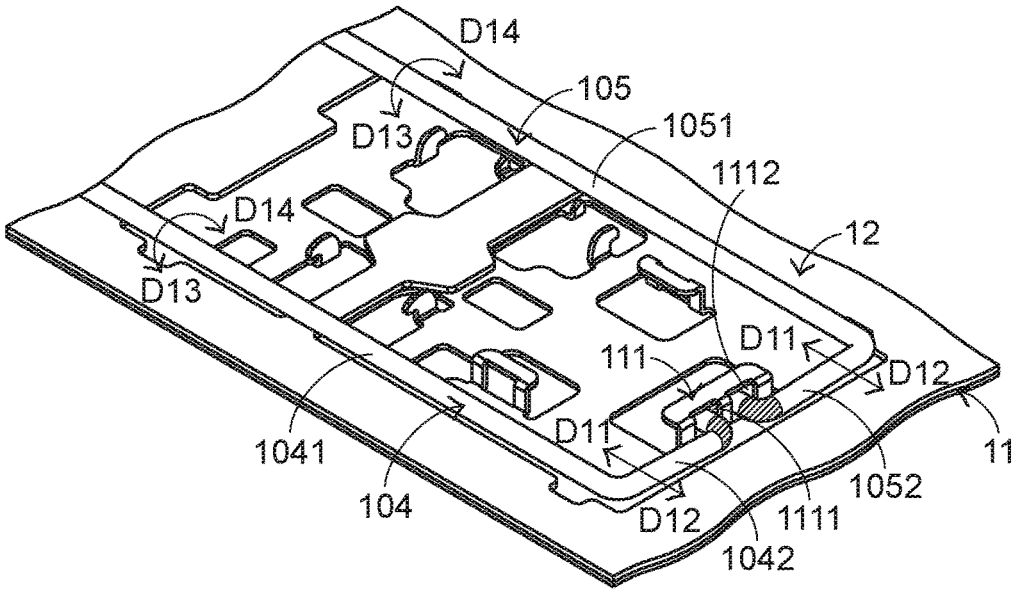
FIG.5 PRIOR ART
FIG. 5 schematically illustrates the actions of the first stabilizer bar and the second stabilizer bar of the conventional keyboard device.
Figure 6:
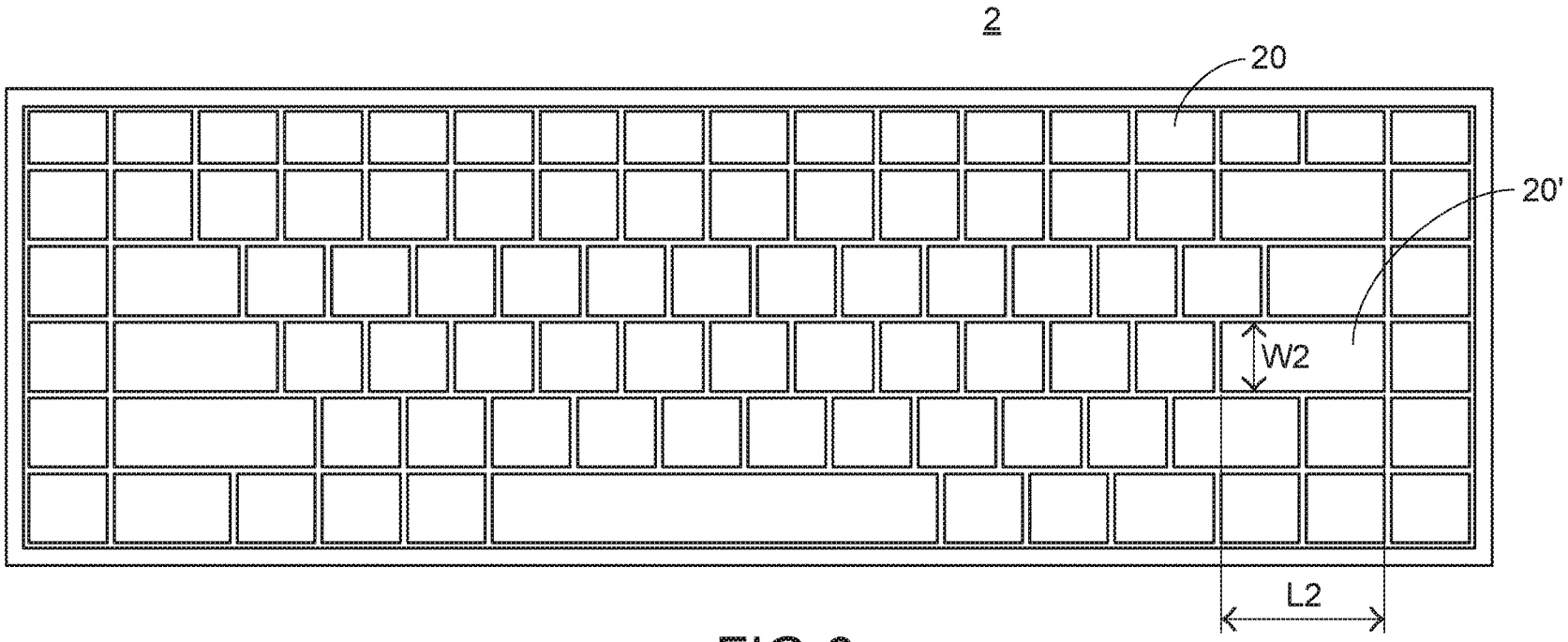
FIG. 6 is a schematic top view illustrating the outer appearance of a keyboard device according to a first embodiment of the present invention.

FIG. 6 is a schematic top view illustrating the outer appearance of a keyboard device according to a first embodiment of the present invention. The keyboard device 2 comprises plural key structures 20 and 20'. These key structures 20 and 20' are exposed outside the keyboard device 2. When one of the key structures 20 and 20' is depressed by the user's finger, a corresponding key signal is generated to a computer (not shown) that is in communication with the keyboard device 2. Consequently, the computer executes a function corresponding to the depressed key structure. The length of the key structure 20 is slightly larger than the width of the key structure 20. The length L2 of the key structure 20' is much larger than the width W2 of the key structure 20'.

Figure 7:
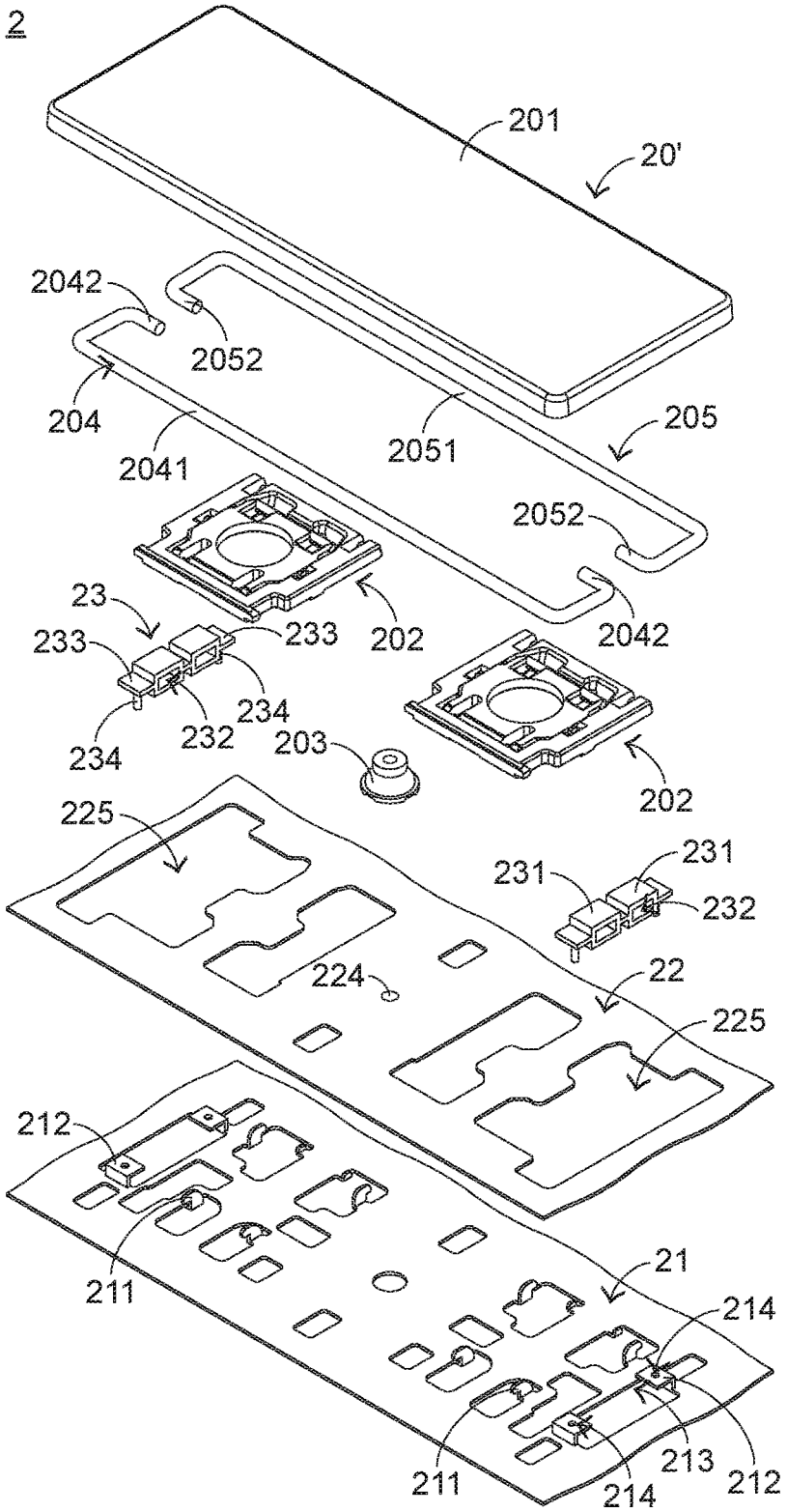
FIG. 7 is a schematic exploded view illustrating a portion of the keyboard device according to the first embodiment of the present invention.
Figure 8:
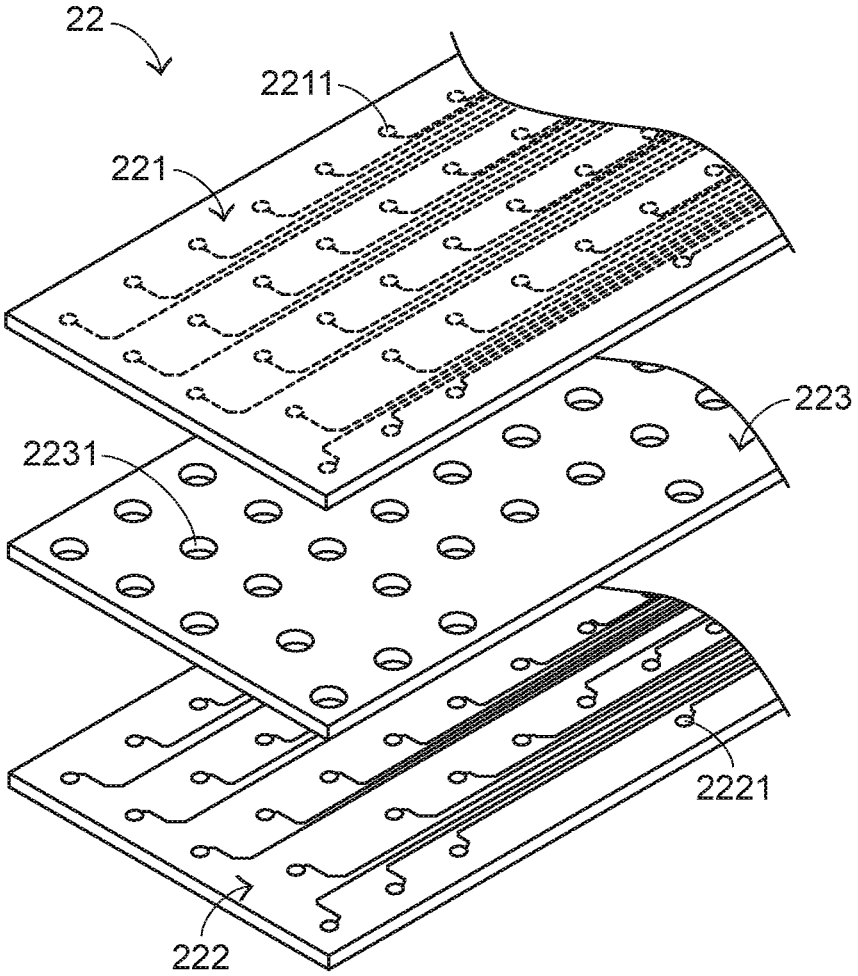
FIG. 8 is a schematic exploded view illustrating a portion of the switch circuit board of the keyboard device according to the first embodiment of the present invention.

Hereinafter, the inner structure of the keyboard device 2 will be illustrated with reference to FIGS. 7 and 8. FIG. 7 is a schematic exploded view illustrating a portion of the keyboard device according to the first embodiment of the present invention. FIG. 8 is a schematic exploded view illustrating a portion of the switch circuit board of the keyboard device according to the first embodiment of the present invention. In addition to the plural key structures 20 and 20', the keyboard device 2 further comprises a base plate 21, a switch circuit board 22 and plural soft fixing elements 23. The base plate 21 is located under the plural key structures 20 and 20' and connected with the plural key structures 20 and 20'. The base plate 21 comprises plural base plate hooks 211, plural bent structures 212, plural notches 213 and plural fixing holes 214. The plural base plate hooks 211 are disposed on a top surface of the base plate 21 so as to be connected with the plural key structures 20 and 20'. The plural bent structures 212 are formed on the base plate 21. Each bent structure 212 corresponds to one soft fixing element 23. Each notch 213 corresponds to one bent structure 212. Moreover, each notch 213 is defined by the corresponding bent structure 212. The notch 213 is used for receiving the corresponding soft fixing element 23. Each fixing hole 214 corresponds to one bent structure 212. The fixing hole 214 is formed in the corresponding bent structure 212 and located beside the notch 213. In a preferred embodiment, every two fixing holes 214 correspond to one bent structure 212, and the two fixing holes 214 are respectively located at two opposite sides of the notch 213. In an embodiment, the base plate 21 is made of a metallic material.

The switch circuit board 22 is arranged between the plural key structures 20, 20' and the base plate 21. When the switch circuit board 22 is triggered by one of the plural key structures 20 and 20', a corresponding key signal is generated. The switch circuit board 22 comprises an upper wiring plate 221, a lower wiring plate 222, a separation layer 223, a key switch 224 and plural openings 225. The upper wiring plate 221 comprises an upper circuit pattern 2211. In addition, the upper circuit pattern 2211 is formed on a bottom surface of the upper wiring plate 221. The lower wiring plate 222 is located under the upper wiring plate 221. The lower wiring plate 222 comprises a lower circuit pattern 2221. In addition, the lower circuit pattern 2221 is formed on a top surface of the lower wiring plate 222. The separation layer 223 is arranged between the upper wiring plate 221 and the lower wiring plate 222. In addition, the separation layer 223 comprises plural perforations 2231 corresponding to plural keycaps 201. The upper circuit pattern 2211 and the lower circuit pattern 2221 are separated from each other through the separation layer 223. Moreover, plural key switches 224 are defined by the upper circuit pattern 2211, the plural perforations 2231 and the lower circuit pattern 2221 collaboratively. Each key switch 224 is aligned with the corresponding key structure 20 or 20'. When the key switch 224 is triggered by the corresponding key structure 20 or 20', the corresponding key signal is generated. Each opening 225 is aligned with one corresponding soft fixing element 23. The corresponding soft fixing element 23 is penetrated through the opening 225. Consequently, a portion of the soft fixing element 23 is located over the switch circuit board 22. In an embodiment, the switch circuit board 22 is a membrane circuit board.

Each of the key structures 20' comprises a keycap 201, at least one scissors-type connecting element 202, an elastic element 203, a first stabilizer bar 204 and a second stabilizer bar 205. The scissors-type connecting element 202 is connected with the corresponding keycap 201 and the plural base plate hooks 211 of the base plate 21. Through the scissors-type connecting element 202, the keycap 201 is fixed on the base plate 21 and movable relative to the base plate 21. The elastic element 203 is arranged between the corresponding keycap 201 and the switch circuit board 22, and aligned with the corresponding key switch 224. When the elastic element 203 is pushed by the keycap 201, the corresponding key switch 224 is triggered. In an embodiment, the elastic element 203 is a rubbery elastomer, and the scissors-type connecting element 202 is made of a plastic material.

Please refer to FIGS. 7 and 8 again. Both of the first stabilizer bar 204 and the second stabilizer bar 205 are connected with the keycap 201. The first stabilizer bar 204 comprises a first linking bar part 2041 and two first hook parts 2042. The first linking bar part 2041 is connected with the keycap 201. The two first hook parts 2042 are located at two ends of the first stabilizer bar 204, respectively. Similarly, the second stabilizer bar 205 comprises a second linking bar part 2051 and two second hook parts 2052. The second linking bar part 2051 is connected with the keycap 201. The two second hook parts 2052 are located at two ends of the second stabilizer bar 205, respectively. Moreover, the keycap 201 comprises plural first coupling parts (not shown) and plural second coupling parts (not shown). The plural first coupling parts are disposed on an inner surface of the keycap 201 and connected with the scissors-type connecting element 202. The plural second coupling parts are also are disposed on the inner surface of the keycap 201. Moreover, the plural second coupling parts are connected with the first linking bar part 2041 and the second linking bar part 2051.

Figure 9:
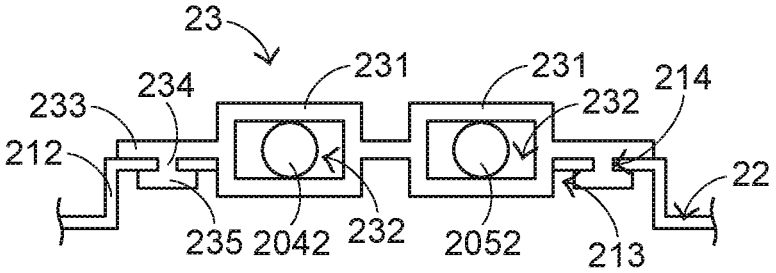
FIG. 9 is a schematic side view illustrating the combination of the first stabilizer bar, the second stabilizer bar and the plural soft fixing elements of the keyboard device according to the first embodiment of the present invention.

FIG. 9 is a schematic side view illustrating the combination of the first stabilizer bar, the second stabilizer bar and the plural soft fixing elements of the keyboard device according to the first embodiment of the present invention. Please refer to FIGS. 7, 8 and 9. The plural soft fixing elements 23 are disposed on the base plate 21 and connected with the first hook parts 2042 and the second hook parts 2052. Each soft fixing element 23 corresponds to one first hook part 2042 and/or one second hook part 2052. Moreover, the soft fixing element 23 comprises at least one main body 231, at least one accommodation space 232, at least one extension structure 233 and at least one fixing post 234. In a preferred embodiment, the soft fixing element 23 comprises two main bodies 231, two accommodation spaces 232, two extension structures 233 and two fixing posts 234. The relationships between these components will be described as follows. The accommodation spaces 232 are disposed within the corresponding main bodies 231. The first hook parts 2042 and the second hook parts 2052 are inserted into the corresponding accommodation spaces 232. Consequently, the first hook parts 2042 and the second hook parts 2052 are permitted to be moved within the corresponding accommodation spaces 232. The extension structures 233 are protruded externally from the corresponding main bodies 231 and contacted with the corresponding bent structures 212. The structure between every two adjacent main bodies 231 is a joint structure rather than the extension structure 233. Each fixing post 234 corresponds to one extension structure 233 and disposed on a bottom surface of the extension structure 233. When the main bodies 231 of the soft fixing elements 23 are partially received in the corresponding notches 213, the fixing posts 234 are penetrated through the corresponding fixing holes 214. Consequently, the soft fixing elements 23 are initially fixed on the base plate 21. Preferably, the soft fixing elements 23 are made of polysiloxane or polymerized siloxane (i.e., silicone resin) or a soft plastic material.

After the fixing posts 234 are penetrated through the corresponding fixing holes 214, the portions of the fixing posts 234 penetrated through the corresponding fixing holes 214 are thermally treated to form plural hot melt fixing structures 235. Consequently, the soft fixing elements 23 are firmly fixed on the base plate 21. In other words, the soft fixing elements 23 and the base plate 21 are combined together.

The operations of depressing the key structure 20' will be described as follows. While the keycap 201 of any key structure 20' is depressed, the keycap 201 is moved downwardly relative to the base plate 21. Since the scissors-type connecting element 202 is pushed by the keycap 201, the scissors-type connecting element 202 is correspondingly swung. Moreover, as the keycap 201 is moved downwardly to push the elastic element 203, the elastic element 203 is subjected to deformation to trigger the corresponding key switch 224. Consequently, the corresponding key signal is generated. When the key structure 20' is no longer depressed, the keycap 201 is moved upwardly relative to the base plate 21 in response to a restoring elastic force of the elastic element 203. As the keycap 201 is moved upwardly, the scissors-type connecting element 202 is correspondingly swung and switched from the stacked state to the open-scissors state again. Consequently, the keycap 201 is returned to its original position.

While the keycap 201 of the key structure 20' is moved upwardly or downwardly relative to the base plate 21, the first hook parts 2042 of the first stabilizer bar 204 and the second hook parts 2052 of the second stabilizer bar 205 are moved and rotated within the corresponding accommodation spaces 232 of the soft fixing elements 23. The four lateral sides of the accommodation space 232 are enclosed by the corresponding main body 231. Consequently, the first hook parts 2042 and the second hook parts 2052 are contacted with the soft fixing elements 23 only, but not contacted with the base plate 21. Since the first hook parts 2042 and the second hook parts 2052 are not contacted with the base plate 21, the first hook parts 2042 and the second hook parts 2052 do not collide with the base plate 21 to generate the unpleasant noise. Consequently, the keyboard device 2 of the present invention is capable of reducing the noise.

Figure 10:
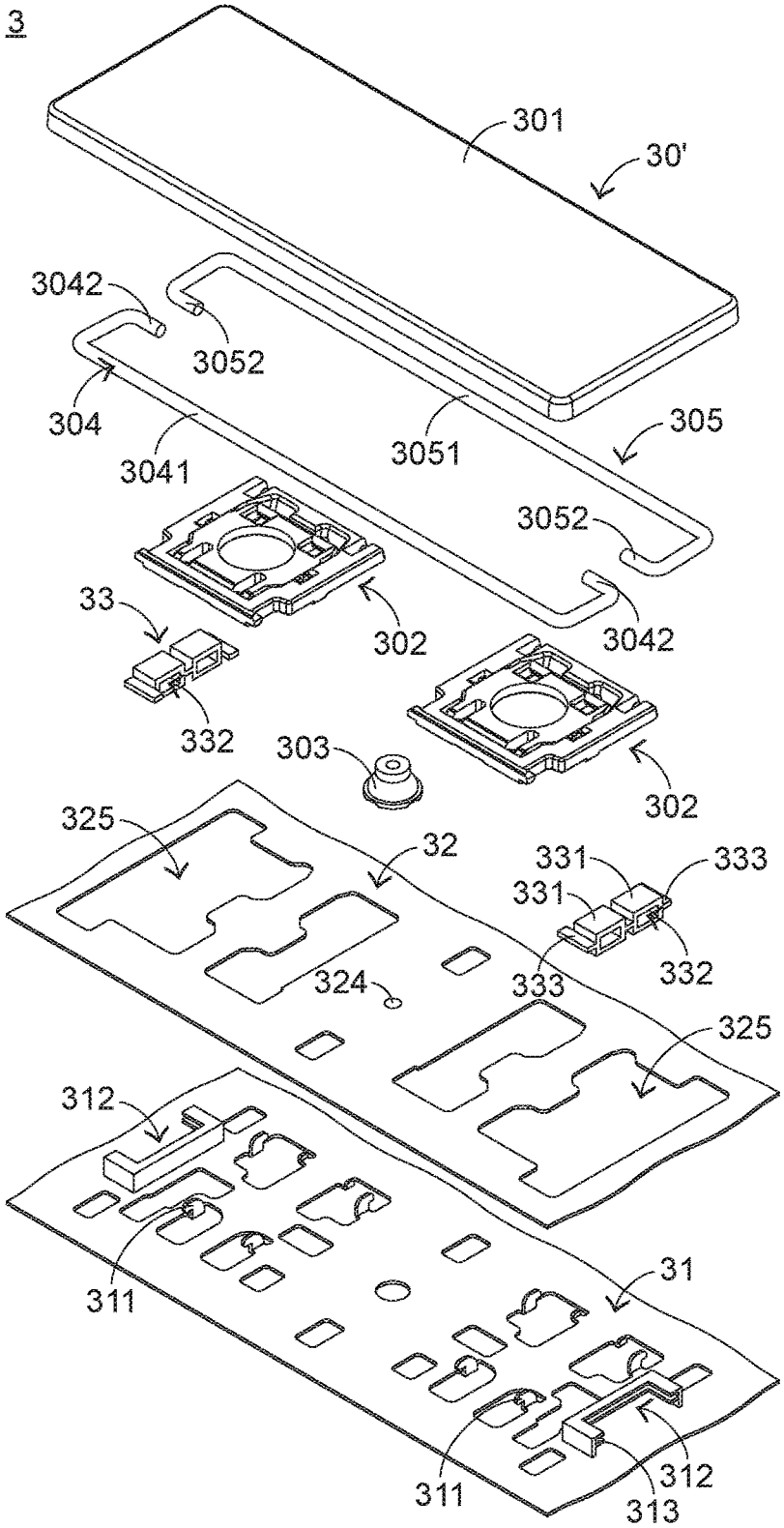
FIG. 10 is a schematic exploded view illustrating a portion of a keyboard device according to a second embodiment of the present invention.
Figure 11:
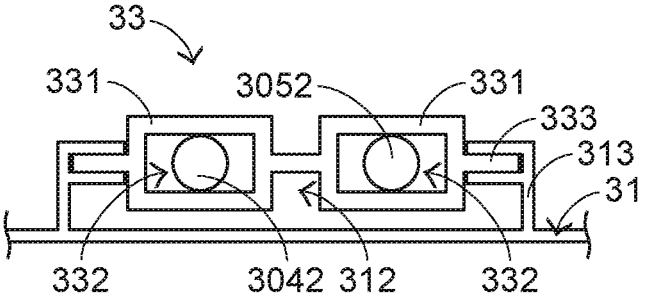
FIG. 11 is a schematic side view illustrating the combination of the first stabilizer bar, the second stabilizer bar and the plural soft fixing elements of the keyboard device according to the second embodiment of the present invention.

The present invention further provides a keyboard device of a second embodiment, which is distinguished from the first embodiment. FIG. 10 is a schematic exploded view illustrating a portion of a keyboard device according to a second embodiment of the present invention. FIG. 11 is a schematic side view illustrating the combination of the first stabilizer bar, the second stabilizer bar and the plural soft fixing elements of the keyboard device according to the second embodiment of the present invention. Please refer to FIGS. 10 and 11. The keyboard device 3 comprises plural key structures 30', a base plate 31, a switch circuit board 32 and plural soft fixing elements 33. For brevity, only one key structure 30' is shown in the drawings. Each of the key structures 30' comprises a keycap 301, at least one scissors-type connecting element 302, an elastic element 303, a first stabilizer bar 304 and a second stabilizer bar 305. The first stabilizer bar 304 comprises a first linking bar part 3041 and two first hook parts 3042. The second stabilizer bar 305 comprises a second linking bar part 3051 and two second hook parts 3052. The switch circuit board 32 comprises an upper wiring plate (not shown), a lower wiring plate (not shown), a separation layer (not shown), a key switch 324 and plural openings 325. Except for the following two items, the structures of the keyboard device 3 of this embodiment are substantially identical to those of the keyboard device 2 of the first embodiment, and are not redundantly described herein. Firstly, the structure of the soft fixing element 33 is distinguished from the soft fixing element of the first embodiment. Secondly, the structure of the base plate 31 is distinguished.

Please refer to FIGS. 10 and 11. In this embodiment, the soft fixing element 33 comprises two main bodies 331, two accommodation spaces 332 and plural second engaging structures 333. The base plate 31 comprises plural base plate hooks 311, plural notches 312 and plural first engaging structures 313. The plural notches 312 are located over the base plate 31 and aligned with the corresponding soft fixing elements 33. The main bodies 331 of the soft fixing element 33 are received in the corresponding notch 312. Each first engaging structure 313 is disposed on the base plate 31 and located beside the corresponding notch 312. The structures of the main body 331 and the accommodation space 332 are similar to those of the first embodiment, and are not redundantly described herein. In this embodiment, the second engaging structure 333 is protruded externally from the main bodies 331 and complementary to the first engaging structure 313. The second engaging structure 333 is movable relative to the first engaging structure 313. When the main bodies 331 are received in the notch 312, the second engaging structure 333 is engaged with the first engaging structure 313. Consequently, the soft fixing element 33 is fixed on the base plate 31.

In this embodiment, the first engaging structure 313 is a track beside the notch 312, and the second engaging structure 333 is a sliding block that is complementary to the track. The examples of the first engaging structure and the second engaging structure are presented herein for purpose of illustration and description only. In another embodiment, the first engaging structure is a sliding block, and the second engaging structure is a track that is complementary to the sliding block. The operations of the keyboard device 3 of this embodiment are similar to those of the keyboard device 2 of the first embodiment, and are not redundantly described herein. That is, the first hook parts 3042 and the second hook parts 3052 are separated from the base plate 31 through the soft fixing elements 33. Consequently, the keyboard device is capable of reducing the noise. In comparison with the first embodiment, the soft fixing element 33 is coupled with the base plate 31 in a movable manner.

From the above descriptions, the present invention provides the keyboard device. The soft fixing elements are disposed on the base plate. The first hook parts and the second hook parts are separated from the base plate through the soft fixing elements. There are two approaches of combining the soft fixing elements and the base plate together. In accordance with a first approach, the fixing posts are penetrated through the corresponding fixing holes to initially fix the soft fixing elements on the base plate and then the fixing posts are thermally treated to form the hot melt fixing structures. In accordance with a second approach, the first engaging structure and the second engaging structure having complementary shapes are engaged with each other in a movable manner, so that the soft fixing elements are fixed on the base plate. The first connecting structures and the second connecting structures that are made of the metallic material and used in the conventional keyboard device are replaced by the soft fixing elements according to the present invention. The soft fixing elements are made of the soft material. Even if the first hook parts and the second hook parts are made of the metallic material, the first hook parts and the second hook parts are only contacted with the soft fixing elements but not contacted with the metallic material. That is, the metallic components do not collide with the base plate to generate the unpleasant noise. Consequently, the keyboard device of the present invention is capable of reducing the noise.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a key structure comprising a keycap and a stabilizer bar, wherein the keycap is exposed outside the keyboard device, the stabilizer bar is connected with the keycap, and comprises a linking bar part and a hook part, wherein the linking bar part is connected with the keycap, and the hook part is located at an end of the linking bar part;

a switch circuit board located under the key structure, wherein when the switch circuit board is triggered, a key signal is generated;

a base plate located under the switch circuit board, and supporting the key structure; and a soft fixing element disposed on the base plate and connected with the hook part, and comprising a main body and an accommodation space, wherein the accommodation space is disposed within the main body, and the hook part is inserted into the accommodation space, so that the hook part is permitted to be moved within the accommodation space;

wherein the base plate comprises:

a bent structure corresponding to the soft fixing element, wherein the bent structure is formed on the base plate;

a notch defined by the bent structure, wherein the main body is partially received in the notch; and a fixing hole formed in the bent structure and located beside the notch.

2. The keyboard device according to claim 1, wherein the soft fixing element further comprises:

an extension structure protruded externally from the main body and contacted with the bent structure; and a fixing post disposed on a bottom surface of the extension structure, wherein when the main body is received in the notch, the fixing post is penetrated through the fixing hole, so that the soft fixing element is initially fixed on the base plate.

3. The keyboard device according to claim 2, wherein after the fixing post is penetrated through the fixing hole, a portion of the fixing post penetrated through the fixing hole is thermally treated to form a hot melt fixing structure, so that the soft fixing element is firmly fixed on the base plate.

4. A keyboard device, comprising:

a key structure comprising a keycap and a stabilizer bar, wherein the keycap is exposed outside the keyboard device, the stabilizer bar is connected with the keycap, and comprises a linking bar part and a hook part, wherein the linking bar part is connected with the keycap, and the hook part is located at an end of the linking bar part;

a switch circuit board located under the key structure, wherein when the switch circuit board is triggered, a key signal is generated;

a base plate located under the switch circuit board, and supporting the key structure; and a soft fixing element disposed on the base plate and connected with the hook part, and comprising a main body and an accommodation space, wherein the accommodation space is disposed within the main body, and the hook part is inserted into the accommodation space, so that the hook part is permitted to be moved within the accommodation space;

wherein the base plate comprises:

a notch corresponding to the soft fixing element, wherein the notch is located over the base plate, and the main body is partially received in the notch; and a first engaging structure disposed on the base plate and located beside the notch;

wherein the soft fixing element further comprises a second engaging structure, wherein the second engaging structure is protruded externally from the main body, complementary to the first engaging structure, and movable relative to the first engaging structure, wherein when the main body is received in the notch, the first engaging structure and the second engaging structure are engaged with each other.

5. The keyboard device according to claim 4, wherein the first engaging structure is a track, and the second engaging structure is a sliding block.

6. The keyboard device according to claim 1, wherein the switch circuit board has an opening corresponding to the soft fixing element, wherein the soft fixing element is penetrated through the opening, so that the hook part is inserted into the accommodation space.

7. The keyboard device according to claim 4, wherein the switch circuit board has an opening corresponding to the soft fixing element, wherein the soft fixing element is penetrated through the opening, so that the hook part is inserted into the accommodation space.

8. The keyboard device according to claim 4, wherein the key structure further comprises:

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board, wherein when the elastic element is pushed by the keycap, the switch circuit board is triggered by the elastic element, wherein when the elastic element is not pushed by the keycap, the elastic element provides an elastic force to the keycap.

9. The keyboard device according to claim 1, wherein the key structure further comprises:

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board, wherein when the elastic element is pushed by the keycap, the switch circuit board is triggered by the elastic element, wherein when the elastic element is not pushed by the keycap, the elastic element provides an elastic force to the keycap.

* * * * *